United States Patent [19]

Moriya

[11] Patent Number: 4,516,848

[45] Date of Patent: May 14, 1985

[54] CHARGING DEVICE FOR AN ELECTROSTATIC COPYING MACHINE

[75] Inventor: Shigeru Moriya, Nikaho, Japan

[73] Assignee: TDK Corporation, Tokyo, Japan

[21] Appl. No.: 433,434

[22] Filed: Oct. 8, 1982

[30] Foreign Application Priority Data

Mar. 5, 1982 [JP] Japan ..... 57-31198[U]

[51] Int. Cl.[3] ..... G03G 15/00

[52] U.S. Cl. ..... 355/3 CH; 355/14 CH; 355/15; 250/324; 361/225

[58] Field of Search ..... 250/324, 325, 326; 361/226, 229, 230; 355/15, 3 CH, 14 CH; 15/1.5 R; 51/392, 400, DIG. 10

[56] References Cited

U.S. PATENT DOCUMENTS

| | | | |
|---|---|---|---|
| 3,496,352 | 2/1970 | Jugle | 250/326 |
| 3,840,744 | 10/1974 | Hedman, Jr. | 250/324 |
| 3,842,273 | 10/1974 | Van Buskirk | 250/324 |
| 3,844,657 | 10/1974 | Schweriner | 15/1.5 R X |
| 3,845,307 | 10/1974 | Gallo | 250/324 X |
| 3,848,994 | 11/1974 | Fraser | 15/1.5 R X |
| 3,870,883 | 3/1975 | Oagley | 250/324 |
| 3,891,846 | 6/1975 | Ito | 250/324 |
| 3,953,772 | 4/1976 | Zimmer | 15/1.5 R X |
| 3,978,379 | 8/1976 | Del Vecchio | 51/392 X |
| 4,073,587 | 2/1978 | Selwyn | 355/3 CH |

*Primary Examiner*—A. T. Grimley
*Assistant Examiner*—Terry L. Flower
*Attorney, Agent, or Firm*—Robert Scobey

[57] ABSTRACT

A charging device for an electrostatic copying machine in which a tongue piece is positioned adjacent to a charging wire. A DC signal is applied to a piezoelectric element to flex the tongue piece to a position in contact with or closely adjacent to the charging wire, and a high frequency signal is superimposed onto the DC signal so as to flex and vibrate the tongue piece against the charging wire. The vibratory piezoelectric element may be fixed to and suspended from the charging wire; alternatively the piezoelectric vibratory element may support the charging wire at an intermediate portion of the charging wire.

8 Claims, 32 Drawing Figures

CHARGING DEVICE FOR AN ELECTROSTATIC COPYING MACHINE

BACKGROUND AND BRIEF DESCRIPTION OF THE INVENTION

The present invention relates to a charging device for an electrostatic copying machine, particularly of the type facing a circumferential surface of a photo-sensitive drum or a transfer paper or the like so as to charge the photosensitive surface.

In FIG. 1 is i11ustrated a schematic arrangement of a conventional type of an electrostatic copying machine. In this figure, a light from source 2 is reflected by an original 3, and its image is projected onto a photo-sensitive drum 1 through an optical system including mirrors 4, 5 and lens 6. Toner powders in toner box 7 are fed to a developing unit 8 adjacent to the drum 1, and a transfer paper 9 is supplied to a circumferential surface of the drum 1 through a paper feeding mechanism. Around the circumferential surface of the drum 1 are respectively arranged a first charging device 10 for charging the drum in advance, a second charging device 11 for transferring an electrostatic latent image stored on the surface of the drum onto the transfer paper 9, and a third charging device 12 for separating toner powders from the drum. The transfer paper 9 having a toner image transferred thereon is passed through a fixing unit 13 and discharged on a take-up tray 14.

The charging devices 10 to 12 are constructed so that a charging wire, energized by a high voltage, is arranged in a case. This arrangement exhibits some disadvantages, in that toner powders are apt to be adhered to the wire during operation. The discharging performance of the wire with respect to the drum 1 is decreased and a re-adhering of toner powder to the drum 1 or a hazardous adhering of toner powder to the transfer paper 9 occurs. As a further disadvantage, a cleaning is required generally for every 2,000 hours of operation.

In view of the above-mentioned disadvantages, it is a main object of the present invention to provide a charging device for an electrostatic copying machine, in which a piezoelectric vibratory element is arranged so as to apply a vibratory motion for a specified duration of time to a charging wire for use in charging a photosensitive drum or a transfer paper or the like, and thereby prevent any adhesion of toner powders to the charging wire.

Referring now to the following detailed description and accompanying drawings, several preferred embodiments of a charging device for an electrostatic copying machine constructed in accordance with the present invention will be given to aid in a more complete understanding of the invention.

DETAILED DESCRIPTION

Figure 2:
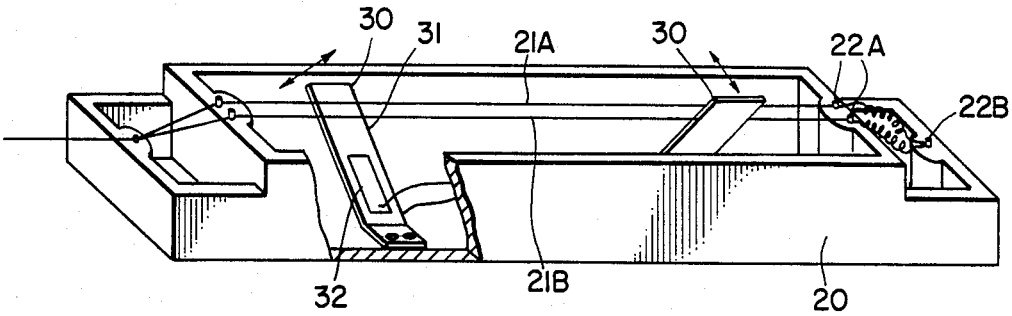
FIG. 2 is a perspective view of a charging device for an electrostatic copying machine embodying the present invention.

FIG. 2 shows a first preferred embodiment of the present invention. In this figure, an insulated case 20 is provided from a longitudinal box-shaped housing, open at its upper end. Two charging wires 21A, 21B made preferably of tungsten to which a high voltage is applied are longitudinally arranged at the open end of the case through guide pins 22A and fixed to the case 20 by pin 22B.

At a bottom part of the case 20 is arranged a piezoelectric vibrator element 30 (two of such elements are shown in FIG. 2). The piezoelectric vibrator element 30 includes a piezoelectric plate 32 adhered to metallic tongue piece 31. A rear end of the metallic tongue 31 is fixed to a bottom part of the case 20, and a leading end of the metallic tongue contacts one of the charging wires 21A, 21B.

The leading end of the metallic tongue 31 is vibrated by energizing the piezoelectric plate 32, and the charging wires 21A, 21B are vibrated under the striking (vibrating) operation of the metallic tongue 31. As a result, it is possible to prevent any adhesion of toner powders to the charging wires 21A, 21B, thereby to overcome the disadvantages of poor discharging to the drum, a readhering of toner powders to the drum, and a hazardous adhesion of toner powders to the transfer paper and the like. As a result, a cleaning of the drum may be eliminated, facilitating drum maintenance. Operation of the piezoelectric vibrator element 30 may occur for a specified duration of time when the copying machine commences its operation or when no operation takes place, for example.

Figure 3:
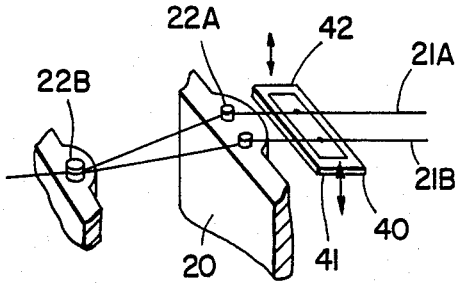
FIG. 3 is a perspective view of another charging device embodying the invention.

FIG. 3 illustrates a second preferred embodiment of the present invention. In this figure, at the open end of insulation case 20, two charging wires 21A, 21B are longitudinally arranged by guide pins 22A and fixed to the case 20 by pin 22B. Piezoelectric vibrator element 40 is fixed between the charging wires 21A, 21B. The piezoelectric vibrator element 40 is constructed such that piezoelectric element plate 42 is adhered to metallic tongue 41. The metallic tongue 41 is vibrated by energizing the piezoelectric plate 42, and the charging wires 21A, 21B are thus vibrated and suspended therefrom as is evident from FIG. 3.

Figure 4:
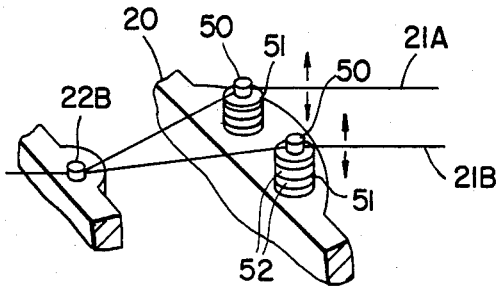
FIG. 4 is a perspective view of yet another charging device embodying the invention.
Figure 6:
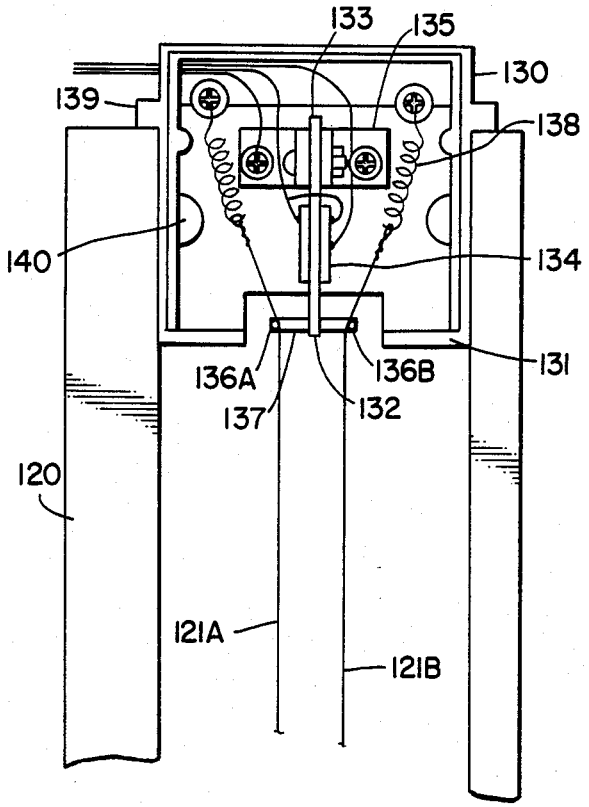
FIG. 6 is a plan view of another charging device embodying the invention.
Figure 7:
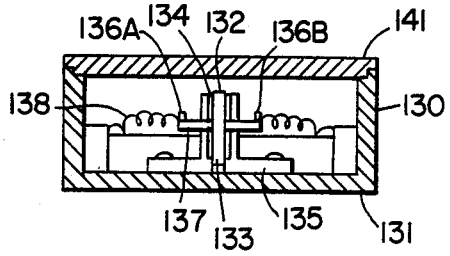
FIG. 7 is a sectional view of the vibratory unit employed in the charging device of FIG. 6.

FIG. 4 illustrates a third preferred embodiment of the present invention. In this figure, at the open end of the insulation case 20, two charging wires 21A, 21B are fixed longitudinally by guide pins 50 and then fixed to the case 20 by pin 22B. In this figure, the pins 50 are vertically arranged on piezoelectric vibratory elements 51 and are fixed to the case 20 through these vibrator elements. The piezoelectric vibratory elements 51 are constructed such that a plurality of piezoelectric plates 52 are stacked vertically and vibrated in their thickness direction. The pins 50 are vibrated by energizing the piezoelectric element plates 52, and the charging wires 21A, 21B are thus vibrated.

Figure 1:
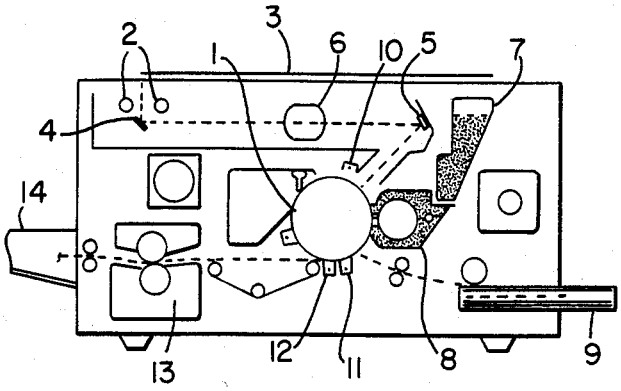
FIG. 1. PRIOR ART
FIG. 1 is a schematic sectional view of a conventional type of electrostatic copying machine.
Figure 5:
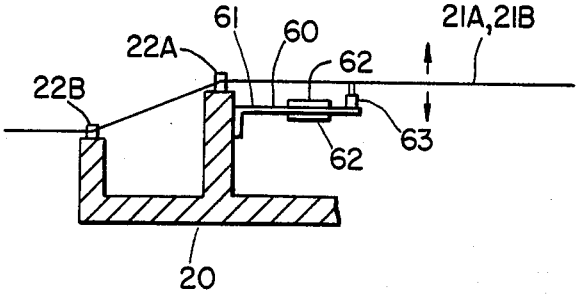
FIG. 5 is a side sectional view of a fourth preferred embodiment of the present invention.

FIG. 5 illustrates a fourth preferred embodiment of the present invention. In this figure, at the open end of the insulation case 20, two charging wires 21A, 21B are longitudinally arranged by guide pin 22A and fixed to the case 20 by pin 22B. Piezoelectric vibrator element 60 is fixed to a side wall of the end part of the case. In this figure, the piezoelectric vibrator element 60 is constructed such that piezoelectric element plates 62 are adhered to both sides of metallic tongue 61. One end of the metallic tongue 61 is fixed to the case 20, and the other end of the tongue is provided with a vibration transmitting member 63 fixed thereto. The vibration transmitting member 63 abuts against the charging wires 21A, 21B. The tongue 61 is vibrated by energizing the piezoelectric element plates 62, and the charging wires 21A, 21B are vibrated through vibrations transferred thereto by transmitting member 63.

Figure 8:
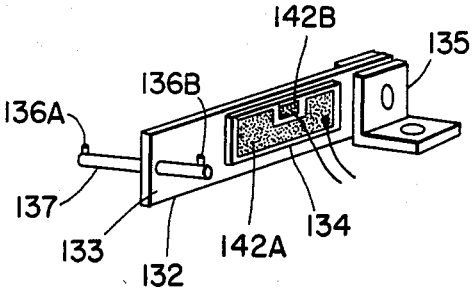
FIG. 8 is a perspective view of part of the vibratory unit of FIG. 7.

With reference to FIGS. 6 to 10, another form of vibrating charging device is described. An aluminum case 120 for a charging device, open at its top end, is employed. At the open end of the case, two charging wires 121A, 121B of tungsten or similar material are longitudinally arranged, to which a relatively high voltage is applied. At least at one end of the case 120 a vibratory unit 130 is fixed, in which a vibratory element 132 is mounted in unit case 131 of insulative resin, generally perpendicular to a bottom of the case. The vibratory element 132 is, as shown in FIG. 8, constructed such that piezoelectric element plates 134 are adhered to metallic vibratory piece 133. A rear end of the metallic vibratory piece 133 is fixed to a bottom part of the unit case 131 through L-shaped fitting 135. At the leading end of the metallic vibratory piece 133, a wire engaging member 137 is fixed, having guide pins 136A, 136B for use in engaging the charging wires 121A, 121B and properly spacing those wires. At one surface of the piezoelectric element plate 134 is arranged a feedback electric plate 142B, separated from the main electric plate 142A. An electric plate (schematically designated 142-1 in FIG. 9, described below) at the other surface of piezoelectric element plate 134 is formed by the metallic vibratory piece 133. The feedback electric pole 142B produces a feedback voltage corresponding to vibration of the vibratory element 132. To the unit case 131 are fixed ends of the springs 138; the other spring ends are engaged with the ends of the charging wires 121A, 121B, respectively, so as to apply a desired tension to the charging wires. Further, the unit case 131 is formed with a projection 139 and a concave recess 140 for defining an installing position of the unit case 131 with respect to the case 120. The vibratory element 132 may be either a bimorphic structure, in which piezoelectric elements are adhered to both sides of the vibratory piece, or a unimorphic structure, in which a piezoelectric élement is adhered to one side of the vibratory piece. The unit case 131 has a top cover 141.

Figure 9:
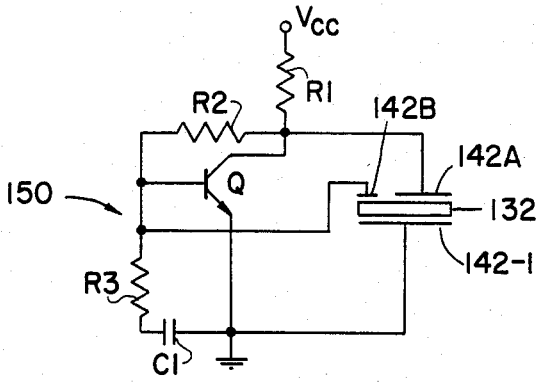
FIG. 9 is a circuit diagram of an oscillation circuit useful in energizing the vibratory unit of FIGS. 6 to 8.
Figure 10:
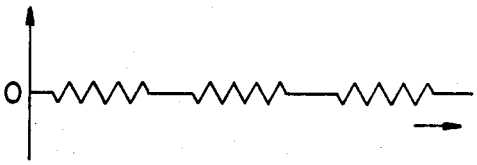
FIG. 10 is a waveform diagram of the high frequency voltage applied to the vibratory element in the circuit of FIG. 9.
Figure 11:
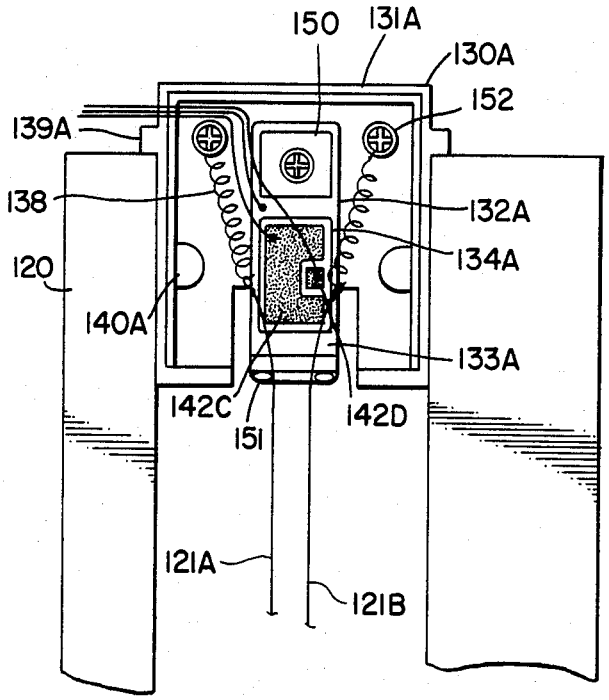
FIG. 11 is a plan view of another charging device embodying the present invention.
Figure 13:
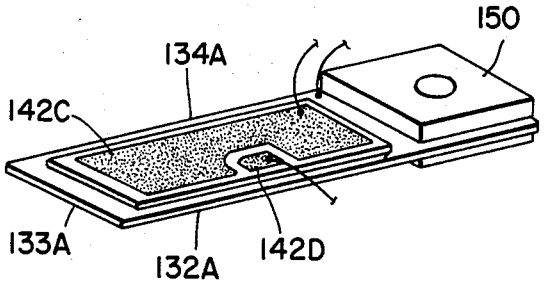
FIG. 13 is a perspective view of the vibrating element in the vibratory unit of FIG. 12.

A suitable driver circuit for use in generating an intermittent vibration in the vibratory element 132 is a self-exciting intermittent oscillation circuit in which the vibratory element 132 is used as an oscillating element, such as the circuit 150 in FIG. 9. A collector of transistor Q is connected to the main electric plate 142A of the vibratory element 132. The base of the transistor is connected to the feedback electric pole 142B, and the emitter is connected to the other electric plate 142-1 (the metallic vibratory piece 133). To the collector of transistor Q is supplied a DC voltage $V_{cc}$ via resistor Rl, and a biasing resistor R2 is connected between the collector and the base. Between the base and emitter is arranged a time constant circuit composed of a resistor R3 and a capacitor C1. Due to this arrangement, the circuit repeats an intermittent oscillation as follows. During a charging period of the capacitor C1, an electric current barely flows in the base of transistor Q, and oscillation in the driver circuit 150 is terminated. When a terminal voltage at the capacitor C1 exceeds a predetermined value, oscillation occurs; in turn, oscillation is terminated when the voltage at the capacitor C1 decreases (by oscillation). As a result, the input voltage applied to the vibratory element 132 is an intermittent, high frequency voltage, as shown in FIG. 10.

In this arrangement, the leading end of the metallic vibratory piece 133 undergoes intermittent vibration by applying an intermittent high frequency voltage (for example, 10 kHz) between the main electric plate 142A and the metallic vibratory piece 133 acting as another electric plate. An intermittent vibration of the charging wires 121A, 121B is thus produced by a rightward or leftward vibration (horizontal vibration) of the metallic vibratory piece 133. Accordingly, the vibration pattern of the charging wires 121A, 121B is more complex than a mere continuous vibration, as in the case of the prior-described embodiments, adhering of toner powders to the charging wires 121A, 121B is effectively prevented, with the consequent advantages noted above resulting. Further, the vibration sound of the charging wires 121A, 121B is not a continuous one, but an intermittent sound, and even if audible, its discordance may be reduced.

Figure 12:
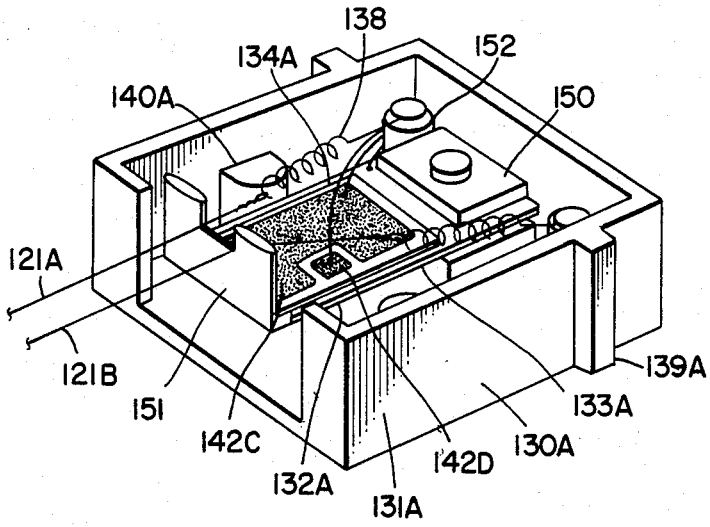
FIG. 12 is a perspective view of the vibratory unit of the charging device of FIG. 11.

FIGS. 11 to 14 illustrate another system embodying the present invention. A vibratory unit 130A is fixed in at least one end of the case 120 of a charging device of an electrostatic copying machine. The vibratory unit 130A includes vibratory element 132A mounted in unit case 131A of insulative resin parallel to a bottom part of the case. The vibratory element 132A is in detail shown in FIG. 13. A piezoelectric element plate 134A is adhered to metallic vibration piece 133A. As shown in FIG. 12, a rear end part of the metallic vibration piece 133A is fixed to a bottom part of the unit case 131A by pins or the like via supporting fitting 150. The leading end of the vibration piece 133A is provided with a guide block 151 of insulative resin which engages the charging wires 121A, 121B and properly spaces them apart. Integral assembly of the guide block 151 and the metallic vibration piece 133A may be performed by an adhesion process, a fixing process, pins and rivets, and the like. One surface of the piezoelectric element plate 134A is provided with a main electric plate 142C and a feedback electric plate 142D. An electric plate at another (opposite) surface of the piezoelectric element plate 134A is provided by the metallic vibration piece 133A (this other plate is designated 142C-1 in FIG. 14, described below). To the spring fixing projections 152 of the unit case 131A are fixed ends of the springs 138, and to the other ends of the springs 138 are engaged the ends of the charging wires 121A, 121B, so that a desired tension force is applied to the charging wires 121A, 121B. The unit case 131A is formed with a projection 139A and a concave recess 140A for defining its fitting position with respect to the case 120 of the charging device.

Figure 14:
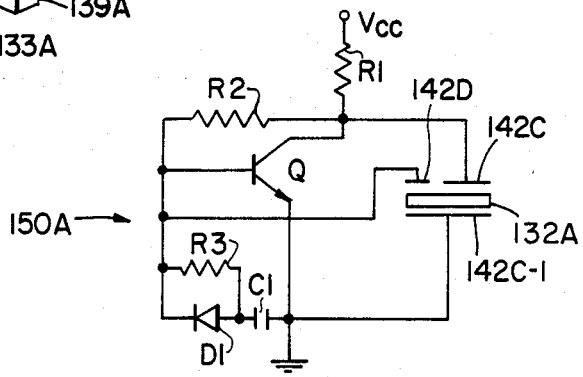
FIG. 14 is a schematic circuit diagram of an oscillation circuit incorporating the vibratory element of FIG. 13.

A suitable driver circuit which causes the vibratory element 132A to undergo intermittent vibration may be a self-exciting intermittent oscillation circuit as shown in FIG. 14, in which the vibratory element 132A is an oscillation element. In this circuit, a diode D1 is connected in parallel with a resistor R3 between the base and emitter of transistor Q so as to permit a smooth discharging of capacitor C1. Other circuit arrangements are the same as shown in FIG. 9, and an intermittent oscillation similarly occurs.

In accordance with this arrangement, a leading end of the metallic vibratory piece 133A is vibrated intermittently by applying an intermittent high frequency voltage ( for example, 10 kHz) between main electric plate 142C on the piezoelectric element plate 134A of the vibratory element 132A and metallic vibratory piece 133A also acting as another electric plate (142C-1). The charging wires 121A, 121B are thus vibrated intermittently by an upward or downward vibration (vertical vibration) of the metallic vibratory piece 133A. As a result, effects similar to that of the system of FIGS. 6 to 10 may be attained.

Figure 15:
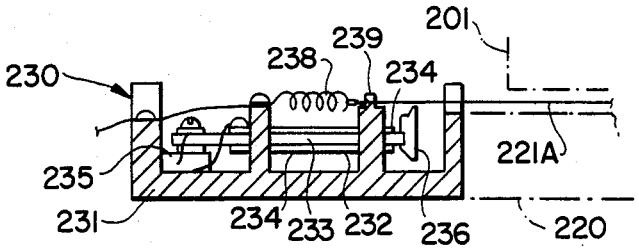
FIGS. 15 and 16 are respectively sectional and plan views of a charging device embodying the present invention.
Figure 16:
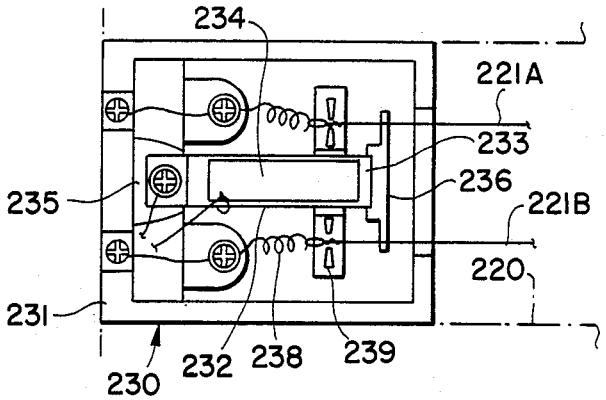
Figure 17A:
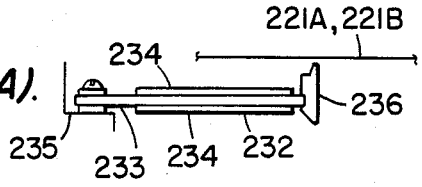
FIGS. 17(A) to 17(C) illustrate a vibratory element in the charging device of FIGS. 15 and 16.
Figure 17B:
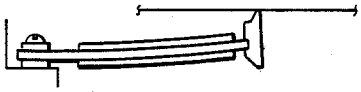
Figure 17C:
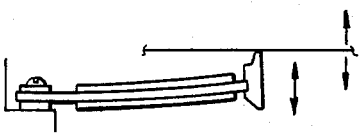

FIGS. 15 and 16 illustrate another charging device embodying the present invention. In these figures, the case 220 (preferably aluminum) is an elongated box, open at its top end. At this open end surface of the case are oppositely and longitudinally arranged two charging wires 221A, 221B of tungsten or the like to which a high voltage is applied. The charging wires are arranged in a specific, spaced apart relation with the photo-sensitive drum 201. At least one end part of the case 220 is fixed with a vibratory unit 230, arranged such that a vibratory element 232 is fixed in the unit case 231 (of insulative resin) in substantially parallel relation with a bottom part of the case. The vibratory element 232 is, as shown in FIGS. 17(A) to 17(C) constructed such that the piezoelectric element plates 234 are adhered to both surfaces of the metallic vibratory piece 233. A rear end of the metallic vibratory piece 233 is fixed by pins or the like to a stepped projection 235 at a bottom part of the unit case 231. An insulative vibratory transmitting member 236 for applying a vibration to the charging wires 221A, 221B is fixed to the leading end of the metallic vibratory piece. In this arrangement, an electric plate is formed at one surface of the piezoelectric element plate 234, and another electric plate at the other surface is provided by the metallic vibratory piece 233. An input voltage $V_{in}$ is applied between these electric plates. One end of each of springs 238 is fixed to the unit case 231; ends of the charging wires 221A, 221B are engaged with the other ends of the springs 238 so as to apply a desired tension force to the charging wires 221A, 221B. The unit case 231 is provided with guide projections 239 for defining a space between the charging wires 221A, 221B.

Figure 18A:
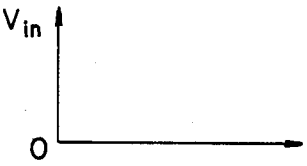
FIGS. 18(A) to 18(C) are waveform diagrams of input voltages to the vibratory element in the device of FIGS. 15 and 16.

Refer now to FIGS. 17 and 18. In the performing of a normal copying operation of an electrostatic copying machine, a constant spacing between the photo-sensitive drum 201 and the charging wires 221A, 221B is required. Therefore, when the input voltage $V_{in}$ to the vibration device is zero, as shown in FIG. 18(A), the insulative vibration transmitting members 236 at the leading end of the vibratory element 232 is slightly spaced from the charging wires 221A, 221B, as shown in FIG. 17(A).

Figure 18B:
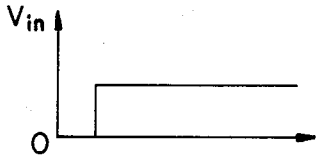
Figure 18C:
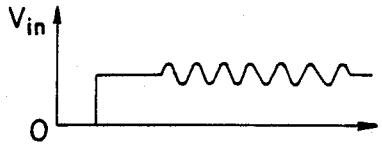

When the copying machine commences its operation or when no copying operation is performed, no difficulties are encountered even if the charging wires 221A, 221B are vibrated. When a DC biasing voltage is applied as input voltage $V_{in}$, as shown in FIG. 18(B), the vibratory element 232 is bent as shown in FIG. 17(B) so as to cause the vibration transmitting member 236 to be in contact with or closely adjacent to the charging wires 221A, 221B. Then when a high frequency voltage is applied, the vibration transmitting member 236 contacts the charging wires 221A, 221B. As shown in FIG. 18(C), a high frequency voltage (for example, 10 kHz) is added to the DC biasing voltage and is applied to the vibratory element 232 as input voltage $V_{in}$ so as to cause the vibratory element to be vibrated. Vibration of a leading end of the vibratory element 232 is applied to the charging wires 221A, 221B through an insulative vibration transmitting member 236.

In this arrangement, since the insulative vibratory transmitting member 236 is normally spaced from the charging wires 221A, 221B, it is possible to maintain the correct position of the charging wires 21A, 21B with respect to the photo-sensitive drum 201. As a result, any disadvantage from the insulative vibratory transmitting member 236 abutting the charging wires 221A, 221B during a copying operation (so as to cause the space between the parts of the charging wires to be narrowed and a corona discharging to be concentrated in the narrow space) is avoided. When the copying machine commences an operation, or when no operation occurs in the copying machine, an input DC biasing voltage havihg a high frequency voltage overlapped therewith may be applied to the vibratory element 232, thereby to vibrate the charging wires 221A, 221B to achieve all the advantages of charging wire vibration noted above.

Figure 19:
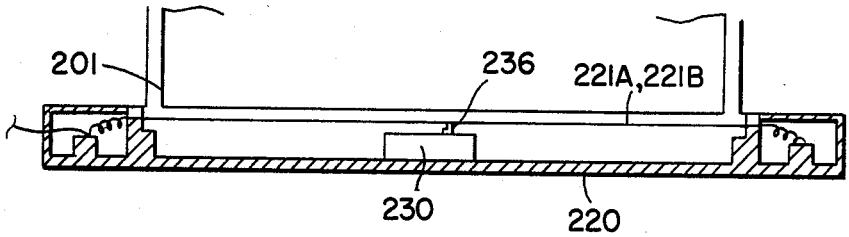
FIG. 19 illustrates another form of charging device embodying the present invention.
Figure 20A:
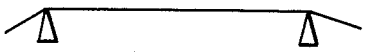
FIGS. 20(A) and 20(B) diagrammatically illustrate the vibrating length of the charging wires in the systems of FIGS. 15 and 16, on the one hand, and FIG. 19 on the other hand.
Figure 20B:
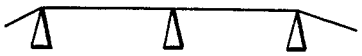

FIG. 19 illustrates another system embodying the present invention. In this arrangement, a vibratory unit 230 for a charging device of an electrostatic copying machine is arranged at an intermediate part of case 220. Bearing in mind that the insulative vibratory transmitting member mounted at the leading end of the vibratory element does not contact the charging wires under normal operating conditions (so as to retain constant the space between the charging wires and the photo-sensitive drum), the position of the vibratory unit 230 is not restricted. The internal structure of the vibratory unit 230 is the same as that of FIGS. 15 and 16. However, in the system of FIGS. 15 and 16, since the vibratory unit 230 is arranged at an end of the machine, the length of the charging wires 221A, 221B applied as a vibratory element, is substantially the entire length of those wires as shown in FIG. 20(A). However, in the system of FIG. 19, since the vibratory unit 230 is positioned at an intermediate part of the case, the length of the charging wires as vibrating elements, as in FIG. 20(B), becomes a half of that shown in FIG. 20(A). In this fashion, it is possible to increase the vibration frequency of the charging wires, to make it higher than that of discordant audible sound.

Figure 21:
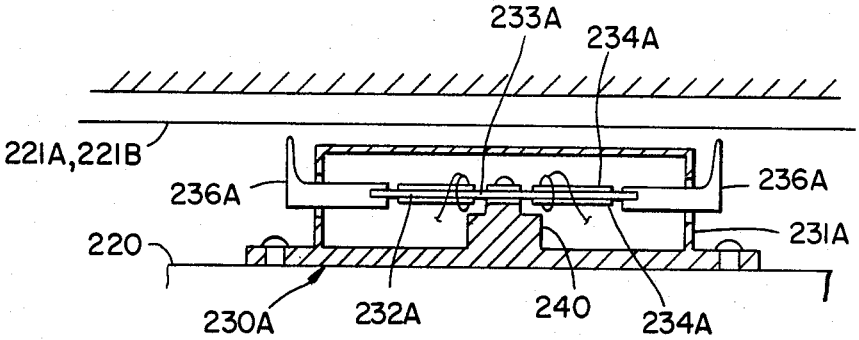
FIG. 21 illustrates yet another charging device embodying the invention.

FIG. 21 illustrates yet another device embodying the present invention. At an intermediate part of the case 220 of the charging device is arranged a vibratory unit 230A. This vibratory unit includes a vibratory element 232A arranged in the unit case 231A in substantially parallel relation with a bottom part of the case. The vibratory element 232A, at an intermediate part of the metallic vibratory piece 233A, is fixed by pins or the like to a fixing projection 240 projected from a bottom part of the case. Piezoelectric element plates 234A are adhered to both front and rear surfaces of the fixed portion. To both ends of the metallic vibratory piece 233A are fixed the insulative vibratory transmitting members 236.

Figure 22:
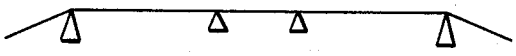
FIG. 22 illustrates the length of the charging wires as vibrating elements in the device of FIG. 21.

The insulative vibratory transmitting members 236A are properly spaced apart from the charging wires 221A, 221B and operated under application of an input voltage as shown in FIG. 18C. In operation, since the length of each of the charging wires 221A, 221B as a vibratory device is divided into three sections, as shown in FIG. 22, the vibratory frequency of the wires may be increased over that of the system of FIG. 19.

Figure 23:
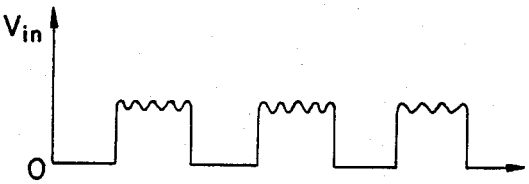
FIG. 23 is a waveform diagram of a suitable voltage for energizing the vibrating elements in the devices of FIGS. 15, 16, 19 and 21.

In the devices of FIGS. 15, 16 and 19 and 21, the DC biasing voltage which is intermittently pulsed, as shown in FIG. 23, may be used in place of DC biasing voltage of stepped form as shown in FIG. 18B. In this case, a high frequency voltage is overlapped with the pulsed DC voltage and is applied to the vibratory element. Application of the input voltage shown in FIG. 23 causes a vibratory sound of the charging wires 221A, 221B to be intermittent, in place of a continuous sound, so that a discordant sound is eliminated. Further, since the vibration pattern of the charging wire may be varied, the cleaning effect of the toner powder is improved.

Figure 24:
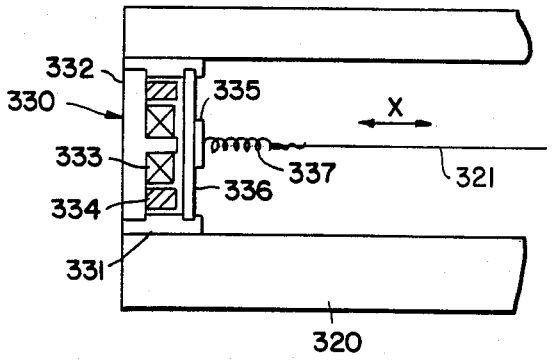
FIGS. 24 to 26 illustrate charging devices embodying the invention for vibrating charging wires respectively in X-axis, Y-axis and Z-axis directions.

FIG. 24 illustrates yet another device embodying the present invention. The case 320 (preferably aluminum) of a charging device is of elongated box shape and open at its top part. At the open end of the case is longitudinally arranged a charging wire 321 of tungsten or the like, to which a relatively high voltage is applied. At least one end part of the case 320 has a vibration unit 330 fixed thereto. The vibration unit 330 includes a unit case 331 preferably of insulative resin, provided with a magnetic core 332 having a center pole therein. A coil 333 is fitted around an outer circumference of the center pole, and a permanent magnet 334 and a vibrator plate 336 having a magnetic body 335 are included. In this arrangement, the magnetic core 332 is fixed to the case 331, and the permanent magnet 334 is fixed to the outer circumference of the magnetic core 332. The vibration plate 336 is supported by the case 331 at its circumferential edge, so that it is closely adjacent to the center pole of the magnetic core 332 and the permanent magnet 334, and the magnetic body 335 is adhered to a central part of the vibration plate 336. A spring 337 is connected to the magnetic body 335, and the charging wire 321 is connected thereto through spring 337.

In this arrangement, AC voltage is applied to the coil 333 so as to cause the vibration plate 336 to be vibrated, thereby to vibrate the charging wire 321 in the direction of arrow X along the length of the wire.

Figure 25:
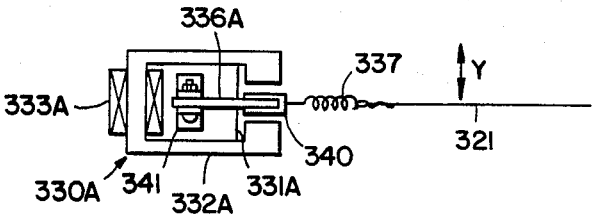

FIG. 25 illustrates another charging device embodying the present invention, adapted to vibrate a charging wire along a (horizontal) Y-axis, transverse to the charging wire. At least one end part of the case of the charging device is provided with a vibration unit 330A, including a vibration plate 336A mounted in unit case 331A (preferably of insulative resin) in a vertical relation with respect to a bottom of said case. The vibratory plate 336A has a permanent magnet 340 at its leading end fixed thereto; its rear end is fixed to a bottom part of the unit case 331A by pins or the like with a supporting fitting 341. The generally C-shaped magnet core 332A is arranged such that its leading ends are oppositely faced, with the permanent magnet 340 being held therebetween, and a coil 333A is wound around a circumference of the magnetic core. Spring 337 connects the permanent magnet 340 to charging wire 321.

In this arrangement, the vibratory plate 336A is vibrated by applying AC voltage to the coil 333A, and the charging wire 321 is thereby vibrated in the direction of arrow Y (horizontal direction) perpendicular to the charging wire.

Figure 26:
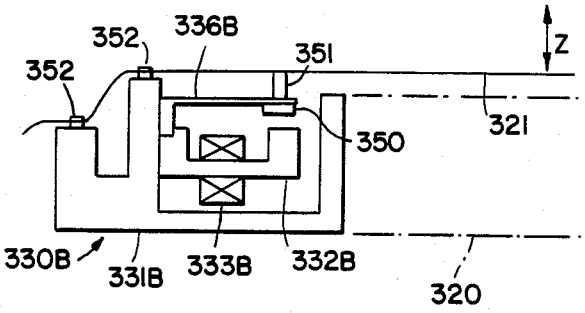

FIG. 26 illustrates another charging device embodying the present invention, adapted to vibrate a charging wire along a (vertical) Z-axis, transverse to the charging wire.

At least one end part of case 320 of the charging device is fixed with a vibration unit 330B, which includes vibratory plate 336B arranged in unit case 331B (preferably of an insulating resin) in a substantially parallel relation with the charging wire 321. A permanent magnet 350 is fixed to the leading end of the vibratory plate 336B; the rear end of that plate is fixed to the inner side surface of the case. The generally C-shaped magnetic core 332B has a coil 333B around its outer circumference, its leading end is oppositely faced against the permanent magnet 350, and its rear end is fixed to the case 331B. At the upper leading end part of the vibratory plate 336B is fixed an insulation supporting body 351, which contacts the charging wire 321. One end of the charging wire 321 is engaged by a pin 352 fixed to the case 331B.

The vibratory plate 336B is vibrated by applying AC voltage to the coil 333B, so that the charging wire 321 is vibrated in a direction of arrow Z (upward and downward directions) perpendicular to the charging wire through the vibrating movement of the insulation supporting body 351.

Figure 27:
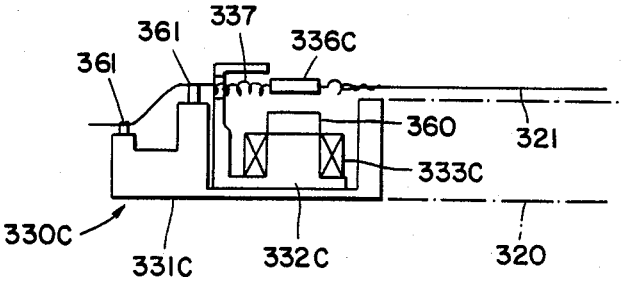
FIG. 27 illustrates another charging device embodying the invention.

FIG. 27 illustrates another device embodying the present invention. At least one end part of the case 320 of a charging device is fixed with a vibratory unit 330C. The vibratory unit 330C includes a magnetic vibratory plate 336C inserted between charging wire 321 and spring 337. A magnetic core 332C having a center pole therein is fixed in the unit case 331C, a coil 333C is arranged at the outer circumference of the case, and a permanent magnet 360 is fixed to a leading end of the center pole. In this fashion, the lower surface of the vibratory plate 336C closely and oppositely faces the permanent magnet 360; the upper surface of that plate is closely adjacent to an extended part of the magnetic core. One end part of the spring 337 is engaged by pin 361 fixed to the case 331C.

The vibratory plate 336C is vibrated by applying AC voltage to the coil 333C, thereby to vibrate the charging wire 321 in an upward or downward direction perpendicular to the charging wire.

As described above, in accordance with the present invention, it is possible to provide a charging device for an electrostatic copying machine in which some piezoelectric vibrator elements are arranged so as to apply a vibration for a desired duration of time to the charging wires for use in charging a photo-sensitive drum or a transfer paper and thereby adhesion of toner powders to the charging wires may effectively be prevented.

The invention should be taken as defined by the following claims.

I claim:

1. In a charging device for an electrostatic copying machine that includes a charging wire means positioned adjacent a surface to be electrostatically charged, the improvement comprising vibratory means for applying a vibration for a desired duration of time to said charging wire means, said vibratory means comprising tongue piece means positioned adjacent to said charging wire means and capable of being flexed into and out of contact with said charging wire means, said tongue piece means including piezoelectric element means which, when energized, causes said tongue piece means to be flexed, and signal means for applying a DC signal to said piezoelectric element means to flex said tongue piece means to a position in contact with or closely adjacent to said charging wire means, said signal means including means for superimposing a high frequency signal onto said DC signal so as to flex and vibrate said tongue piece means against said charging wire means.

2. A charging device for an electrostatic copying machine as set forth in claim 1, in which said tongue piece means is of metal.

3. A charging device for an electrostatic copying machine as set forth in claim 2, in which said piezoelectric element means is mounted upon said tongue piece means.

4. In a charging device for an electrostatic copying machine that includes a charging wire means positioned adjacent a surface to be electrostatically charged, the improvement comprising vibratory means for applying a vibration for a desired duration of time to said charging wire means, said vibratory means including a piezoelectric element as a part thereof, and in which said vibratory means is fixed to and suspended from said charging wire, said charging wire is under tension, and said charging wire is vibrated by vibration of said vibratory means.

5. A charging device for an electrostatic copying machine as set forth in claim 4, in which said vibratory means comprises a plate with a piezoelectric element mounted thereon.

6. A charging device as set forth in claim 5, in which said plate is of metal.

7. In a charging device for an electrostatic copying machine that includes a charging wire means positioned adjacent a surface to be electrostatically charged, the improvement comprising vibratory means for applying a vibration for a desired duration of time to said charging wire means, said vibratory means including a piezoelectric element as a part thereof, in which said charging wire is supported by said vibratory means at an intermediate portion of said charging wire, said vibratory means in turn being mounted on a case.

8. A charging device for an electrostatic copying machine as set forth in claim 7, in which said piezoelectric element comprises a plurality of piezoelectric plates stacked vertically and vibrated in their thickness direction.

* * * * *